US010887690B2

(12) United States Patent
Wu et al.

(10) Patent No.: US 10,887,690 B2
(45) Date of Patent: Jan. 5, 2021

(54) SOUND PROCESSING METHOD AND INTERACTIVE DEVICE

(71) Applicant: Alibaba Group Holding Limited, Grand Cayman (KY)

(72) Inventors: Nan Wu, Beijing (CN); Tao Yu, Bellevue, WA (US); Biao Tian, Beijing (CN)

(73) Assignee: ALIBABA GROUP HOLDING LIMITED, Grand Cayman (KY)

( * ) Notice: Subject to any disclaimer, the term of this patent is extended or adjusted under 35 U.S.C. 154(b) by 0 days.

(21) Appl. No.: 16/183,651

(22) Filed: Nov. 7, 2018

(65) Prior Publication Data

US 2019/0141445 A1 May 9, 2019

(30) Foreign Application Priority Data

Nov. 8, 2017 (CN) ..... 2017 1 1091771

(51) Int. Cl.
*H04R 3/00* (2006.01)
*H04R 1/40* (2006.01)
(Continued)

(52) U.S. Cl.
CPC ..... *H04R 3/005* (2013.01); *G10L 21/0208* (2013.01); *G10L 21/0232* (2013.01);
(Continued)

(58) Field of Classification Search
CPC .. H04N 5/2254; H04N 5/23238; H04N 5/232; H04N 5/247; H04N 5/2259; H04N 5/2624; H04N 5/2627; H04N 13/161; H04N 13/194; H04N 13/246; H04N 13/271; H04N 13/282; H04N 13/32; H04N 13/363; H04N 13/393; H04N 13/398; H04N 3/08; H04N 5/222; H04N 5/2251; H04N 5/23232; H04N 5/76; H04N 5/85; H04N 5/926; G10L 2021/02166; G10L 21/0208; G10L 21/0232; H04R 1/028; H04R 1/406; H04R 2227/003; H04R 27/00; H04R 3/005
(Continued)

(56) References Cited

U.S. PATENT DOCUMENTS 5,737,431 A * 4/1998 Brandstein ..... G01V 1/001 348/E7.083
6,826,282 B1 * 11/2004 Pachet ..... H04S 7/30 381/310
6,879,338 B1 * 4/2005 Hashimoto ..... H04N 5/2251 348/36
6,940,540 B2 * 9/2005 Beal ..... G06K 9/0057 348/169
(Continued)

OTHER PUBLICATIONS

The PCT Search Report and Written Opinion dated Jan. 23, 2019, for PCT Application No. PCT/US18/59696, 10 pages.

*Primary Examiner* — Lun-See Lao
(74) *Attorney, Agent, or Firm* — Lee & Hayes, P.C.

(57) ABSTRACT

A sound processing method and an interactive device are provided. The method includes determining a sound source position of a sound object relative to an interactive device based on a real-time image of the sound object; and performing a sound enhancement on sound data of the sound object based on the sound source position. The above solution solves an existing problem that noises cannot be effectively cancelled in a noisy environment is solved, thus achieving the technical effects of effectively suppressing the noises and improving the accuracy of voice recognition.

13 Claims, 11 Drawing Sheets

(51) Int. Cl.

| | |
|---|---|
| ***G10L 21/0232*** | (2013.01) |
| ***H04R 1/02*** | (2006.01) |
| ***H04R 27/00*** | (2006.01) |
| ***G10L 21/0208*** | (2013.01) |
| ***G10L 21/0216*** | (2013.01) |

(52) U.S. Cl.
CPC ..... *H04R 1/028* (2013.01); *H04R 1/406* (2013.01); *H04R 27/00* (2013.01); *G10L 2021/02166* (2013.01); *H04R 2227/003* (2013.01)

(58) Field of Classification Search
USPC ..... 381/92, 122, 56–58, 150, 182, 186; 379/387.01, 388.01, 390.01; 84/600, 601
See application file for complete search history.

(56) References Cited

U.S. PATENT DOCUMENTS

| | | | | |
|---|---|---|---|---|
| 8,082,448 | B2 * | 12/2011 | Vandervort | G06F 21/32 713/186 |
| 8,185,445 | B1 * | 5/2012 | Perlmuter | G06Q 30/0601 705/26.1 |
| 2011/0055729 | A1 * | 3/2011 | Mason | G06F 3/0425 715/753 |
| 2013/0272548 | A1 * | 10/2013 | Visser | G06K 9/00624 381/122 |
| 2014/0081682 | A1 * | 3/2014 | Perlmuter | G06Q 30/0601 705/7.11 |
| 2016/0071526 | A1 * | 3/2016 | Wingate | G10L 21/028 704/233 |
| 2017/0264999 | A1 | 9/2017 | Fukuda et al. | |
| 2018/0082686 | A1 * | 3/2018 | Wakisaka | H04R 3/005 |

* cited by examiner

SOUND PROCESSING METHOD AND INTERACTIVE DEVICE

CROSS REFERENCE TO RELATED PATENT APPLICATIONS

This application claims priority to Chinese Patent Application No. 201711091771.6, filed on 8 Nov. 2017, entitled "Sound Processing Method and Interactive Device," which is hereby incorporated by reference in its entirety.

TECHNICAL FIELD

The present disclosure relates to the technical field of data processing, and particularly to sound processing methods and interactive devices.

BACKGROUND

With the continuous development of voice recognition technology, voice interaction has been used in an increasing number of occasions. Currently, voice interaction modes mainly include remote voice interaction mode and near-field manual trigger mode.

For remote voice interaction, the clarity and accuracy of voice data have an important impact on the accuracy of recognition of voice interactions. However, in many scenes of voice interactions in places such as airports, train stations, subway stations, shopping malls, etc., voices from a number of people, sounds generated by vehicles, sounds of broadcasts, and mixed reverberation generated by large enclosed spaces, etc., that exist are sources of noises. The volumes of these noises are relatively large, the environments are relatively noisy, and the influence of noisy environments tends to reduce the accuracy of voice interactions.

Existing voice vendors generally acquire voice through a microphone array. This type of method cannot solve the noise problem that exists during voice interactions under such special scenes as "large noises in public places".

No effective solution has yet been proposed to eliminate noises and improve the accuracy of recognition of voice interactions.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter. The term "techniques," for instance, may refer to device(s), system(s), method(s) and/or processor-readable/computer-readable instructions as permitted by the context above and throughout the present disclosure.

The present disclosure aims to provide sound processing methods and interactive devices which can effectively eliminate noises and improve the accuracy of voice recognition in noisy scenes.

The sound processing methods and the interactive devices provided by the present disclosure are implemented as follows:

A sound processing method includes determining a sound source location of a sound object relative to an interactive device based on a real-time image of the sound object; and performing a sound enhancement of sound data of the sound object based on the sound source location.

An interactive device includes processor(s) and memory configured to store processor executable instructions that, when executed by the processor(s), implement the procedure of the above method.

An interactive device includes a camera, processor(s), and a microphone array, wherein the camera is configured to obtain a real-time image of a sound object; the processor(s) is/are configured to determine a sound source location of the sound object relative to an interactive device based on the real-time image of the sound object; and the microphone array is configured to perform a sound enhancement of sound data of the sound object based on the sound source location.

A computer readable storage media having stored computer instructions thereon, the instructions that, when executed, implement procedure of the above method.

After determining a sound source location of sound data, the voice de-noising methods and devices provided by the present disclosure perform a sound enhancement of the sound data according to the determined sound source location, so that sound in a direction of the sound source is strengthened while sound in other directions is suppressed. Therefore, noises of the sound data can be eliminated, and the existing problem that noises cannot be effectively cancelled in a noisy environment is solved, thus achieving the technical effects of effectively suppressing the noises and improving the accuracy of voice recognition.

BRIEF DESCRIPTION OF THE DRAWINGS

In order to describe technical solutions in the embodiments of the present disclosure more clearly, accompanying drawings that are needed for describing the embodiments or the existing technologies are briefly described herein. The drawings described as follows merely represent some embodiments described in the present disclosure. One of ordinary skill in the art can also obtain other drawings based on these accompanying drawings without making any creative effort.

DETAILED DESCRIPTION

In order to enable one skilled in the art to understand the technical solutions of the present disclosure in a better manner, the technical solutions of the embodiments of the present disclosure are described clearly and comprehensively in conjunction with the accompanying drawings of the embodiments of the present disclosure. Apparently, the described embodiments merely represent some and not all of the embodiments of the present disclosure. Based on the embodiments in the present disclosure, all other embodiments obtained by one of ordinary skill in the art without making any creative effort should fall in the scope of protection of the present disclosure.

Considering that voices of a number of people, sounds generated by vehicles, sounds of broadcasts, and mixed reverberation generated by large enclosed spaces, etc., that exist in places such as airports, train stations, subway stations, shopping malls, etc., are sources that generate noises, and the volumes of these noises are relatively large, the accuracy of voice recognition during normal voice interactions will be affected by the noises if human-computer interactive devices are needed in these places, resulting in inaccurate voice recognition.

Accordingly, considering that sound can be directionally de-noised in a targeted manner if a source position of the sound can be recognized (for example, a position of a speaker's mouth), sound data with relatively low noise can be obtained in this way, thereby effectively improving the accuracy of voice recognition.

Figure 1:
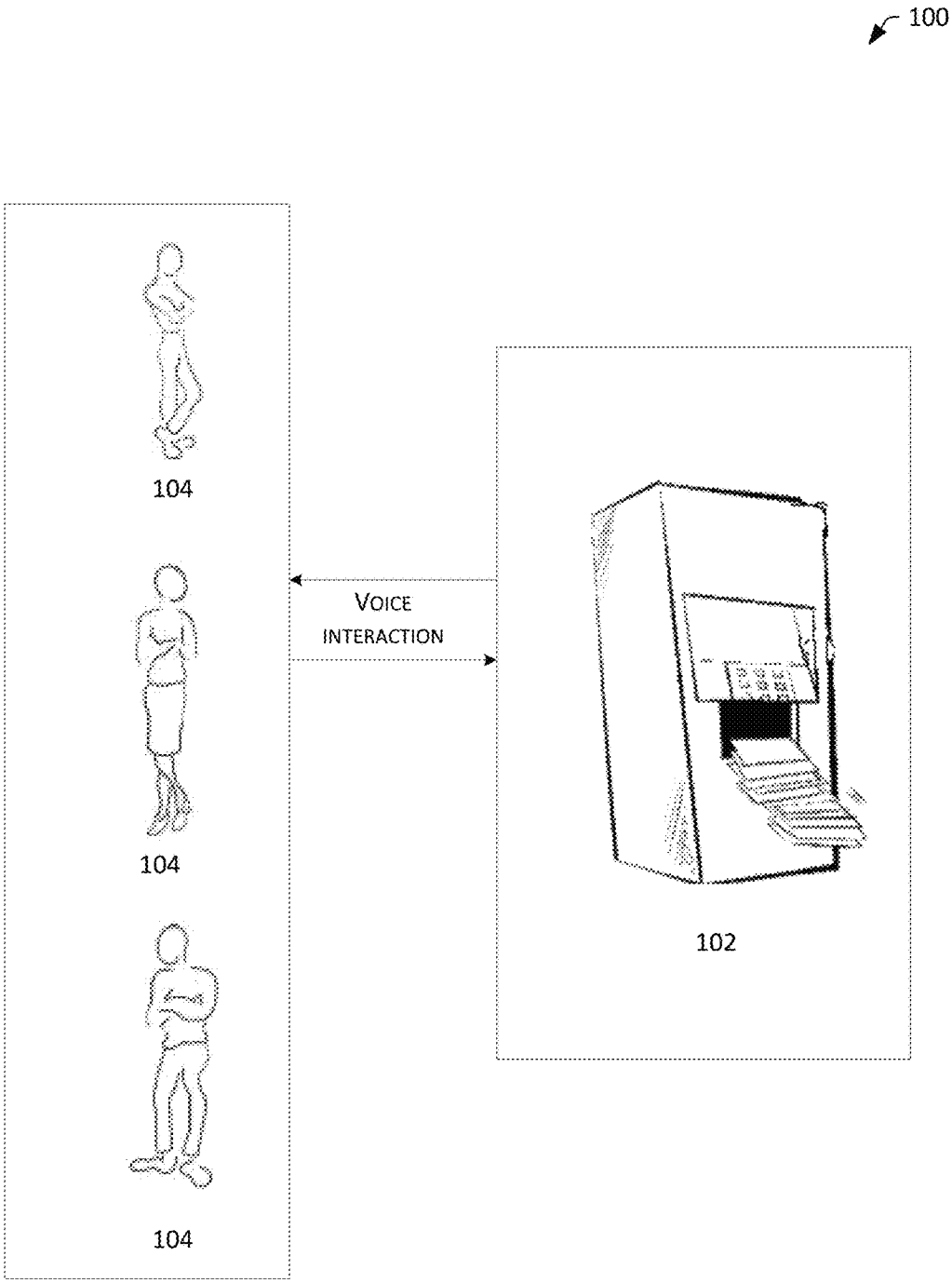
FIG. 1 is a schematic diagram of remote voice interaction based on a wakeup term in existing technologies.

As shown in FIG. 1, a voice interactive system 100 is provided in this example, which includes one or more interactive devices 102, and one or more users 104.

The above voice device may be, for example, a smart speaker, a chat robot, a subway ticket vending machine, a train ticket vending machine, a shopping guidance device, or an application installed in a smart device such as a mobile phone or a computer, etc., which the present disclosure does not have any specific limitation on a type of form thereof.

Figure 2:
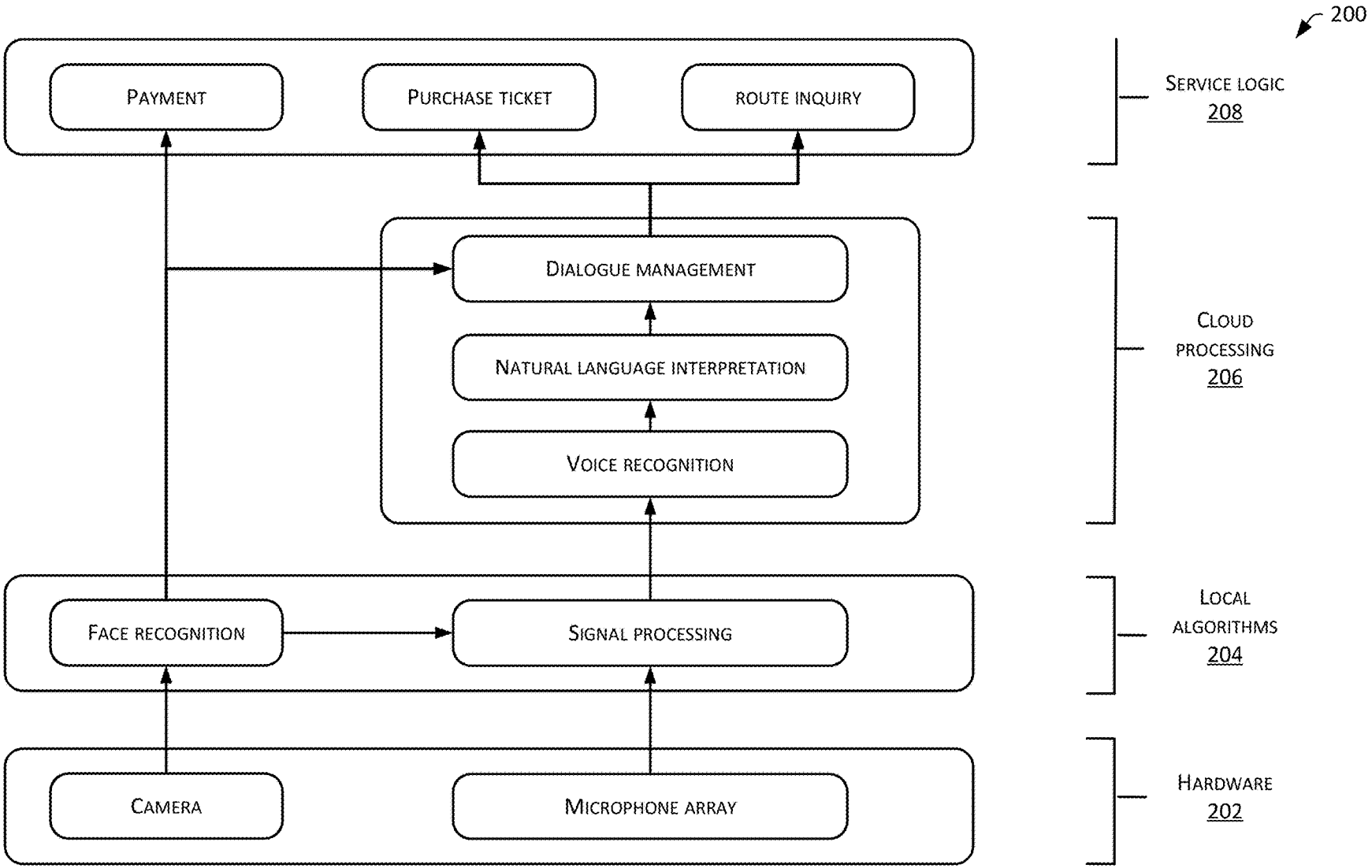
FIG. 2 is a schematic diagram of a logical implementation of a human-machine interaction setting in accordance with the embodiments of the present disclosure.

FIG. 2 is a schematic diagram of a service logic implementation 200 for performing voice interaction based on the voice interactive system of FIG. 1, which may include:

1) Hardware 202: a camera and a microphone array may be included.

The camera and the microphone array may be disposed in the voice device 102 as shown in FIG. 1, and portrait information may be obtained by the camera. A position of the mouth may be further determined based on the obtained portrait information, so that a position of a source of sound may be determined. Specifically, the position of the mouth that utters the sound can be determined through the portrait information, thus determining which direction of sound to be the sound that needs to be obtained.

After determining which direction of sound to be the sound that needs to be obtained, directional de-noising can be performed through the microphone array, i.e., the sound in a direction of sound source can be enhanced by the microphone array while noises in directions different from the direction of sound source are suppressed.

In other words, directional de-noising can be performed on the sound through cooperation between the camera and the microphone array.

2) Local algorithms 204: an algorithm based on face recognition and an algorithm based on a signal processing may be included.

The algorithm based on face recognition can be used to determine an identity of a user, and can be used to identify locations of facial features of the user. Identifying whether the user is facing the device, and user payment authentication, etc., can be achieved by the camera with a local face recognition algorithm.

The signal processing algorithm may determine an angle of a sound source after a position of the sound source has been determined, and thereby control a sound pickup of the microphone array to achieve a directional noise cancellation. At the same time, processing such as a certain degree of amplification, filtering and the like can also be performed on the voice that is obtained.

3) Cloud processing 206: cloud implementation or local implementation can be determined according to the processing capabilities of the device and the usage environment, etc. Apparently, if implemented in the cloud, updating and adjusting an algorithmic model can be performed using big data, which can effectively improve the accuracy of voice recognition, natural speech understanding, and dialogue management.

Cloud processing can mainly include voice recognition, natural language understanding, dialogue management, and the like.

Voice recognition mainly recognizes the content of an obtained voice. For example, if a piece of voice data is obtained and a meaning thereof needs to be understood, then specific text content of that piece of voice needs to be known first. Such process needs to convert the voice into a text using voice recognition.

Whether a text or a text itself, a machine needs to determine the meaning represented by the text, and thus needs a natural language interpretation to determine the natural meaning of the text, so that the intent of a user in the voice content and information included therein can be identified.

Because it is a human-computer interaction process, a Q&A session is involved. A dialog management unit can be used. Specifically, a device can actively trigger a question and an answer, and continue to generate question(s) and answer(s) based on a response of a user. These questions and answers require preset questions and answers that are needed. For example, in a dialogue for purchasing a subway ticket, content of questions and answers such as a ticket of which subway station you need, how many tickets, etc., need to be configured, while a user correspondingly needs to provide a name of the station and the number of tickets. The dialog management also needs to provide corresponding processing logic for situations in which a user needs to change a name of a station, or to modify a response that has been submitted, etc.

For dialogue management, not only regular conversations are set, but conversation content can also be customized for users according to differences in identities of the users, thus leading to a better user experience.

A purpose of dialogue management is to achieve effective communications with users and to obtain information that is needed to perform operations.

Specific voice recognition, natural speech understanding and dialogue management can be implemented in a cloud or locally, which can be determined according to the processing capabilities of a device itself and a usage environment. Apparently, if implemented in the cloud, updating and adjusting an algorithmic model can be performed using big data, which can effectively improve the accuracy of voice recognition, natural speech understanding and dialogue management. For various payment scenarios and voice interaction scenarios, an iterative analysis and optimization of a voice processing model can be performed, so that the experience of payment and voice interaction can be made much better.

4) Service logic 208: services that the device can provide. The services may include, for example, payment, ticket purchase, inquiry, display of query results, etc. Through configurations of hardware, local algorithms, and cloud processing, the device can perform the services that are provided.

For example, for a ticketing device, a user requests to buy a ticket through human-computer interactions using the device, and the device can issue the ticket. For a service consulting device, a user can obtain required information through human-computer interactions using the device. These service scenarios often require a payment. Therefore, a payment process generally exists in the service logic. After a user makes a payment, a corresponding service is provided to the user.

Through the service logic and combining with a "visual+voice" intelligent interaction scheme, noises can be reduced, and the accuracy of recognition can be improved. A two-person conversation scenario can be free from interruption, and the purpose of avoiding a wakeup can be achieved. A user can conduct interactions using a natural voice.

Figure 3:
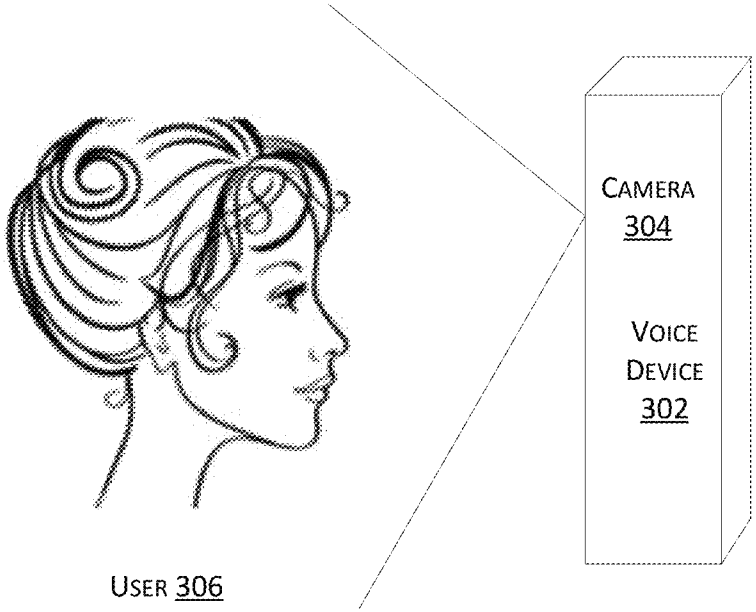
FIG. 3 is a schematic diagram of determining whether a user is facing a device in accordance with the embodiments of the present disclosure.

In implementations, as shown in FIG. 3, a voice device 302 is deployed with a camera 304, and image information of a user 306 can be obtained through the camera 304. As such, whether the user 306 is facing the device 302 and whether the mouth of the user 306 is located can be determined, and thereby a direction of a source of sound can be determined to help performing directional de-noising.

For example, after detecting that a user is standing in a preset area, or a time duration of the user facing a device and whether the user is speaking, the user may be considered to have a need to perform voice interactions with the device. When the voice interactions are performed, directional noise cancellation needs to be performed on the voice.

When determining whether the user is facing the device, this can be performed through face recognition, human body recognition, etc. to determine whether the user is facing the device. For example, whether a person exists in an area covered by the camera may first be identified as shown in FIG. 3. After determining that a person exists, a determination is made as to whether the person faces the device through face recognition. Specifically, facial features of the person (e.g., eyes, mouth, etc.) can be recognized. If eye(s) is/are recognized, the person can be considered to be facing the device. If the eye(s) is/are not recognized, the person can be considered to be facing away from the device.

However, it is worth noting that the above-mentioned manner of determining whether a person is facing a device through the face recognition technology is only an exemplary description. In practical implementations, other methods for determining whether a person is facing a device may also be used, which are not limited in the present disclosure, and may be selected according to actual needs and situations.

Further, a preset distance may be set. A determination is first made as to whether a person appears in an area covered by the camera and within a scope of a distance from the device that is less than or equal to the preset distance. If a person appears within the preset distance, a determination is made as to whether the person is facing the device. For example, infrared recognition, human body sensing sensor, radar detection, etc. can be used to identify whether a person appears within a preset distance. Only after determining that a person exists is the subsequent recognition triggered to identify whether the person is facing the device. This is mainly because a user is far away from the device in some occasions and the user does not generally intend to conduct a voice interaction with the device even if the user is speaking and facing towards the device at that time. Furthermore, an excessive long distance will led to a decrease in the accuracy of voice recognition, and so a preset distance limit can be set to ensure the accuracy of recognition.

However, it is worth noting that the above-mentioned manner of identifying whether a person is present is only an exemplary description. In practical implementations, other methods may be used, such as a ground pressure sensor, etc., which are not limited in the present disclosure. Methods of recognizing the presence of a person can be applied to identify whether a person appears herein. Specifically, which method is used can be selected according to actual needs, which is not limited in the present disclosure.

In order to improve the accuracy of determining whether a user is speaking, a multi-angle, multi-directional camera can be deployed to monitor the user to determine whether the user is speaking. In implementations, considering that a user is facing towards the device in some occasions and talking, the user, however, does not actually attempt to conduct a voice interaction with the device, perhaps having a conversation with another person, or just talking to himself/herself. For example, if a certain smart device is only a device that a user actively triggers to sweep the floor. In this case, if people conduct voice interaction with the device, this would be related to cleaning, or simply saying hello. For example, the content of a voice of a user is "please cleaning the living room". The device can then trigger an acquisition of the user's voice data, and identify the voice content is "please clean the living room" from the voice data in response to determining that the user faces thereto and the mouth is talking. A semantic analysis of the content can determine that the content is related to the smart device, and the device can respond accordingly. For example, an answer of "OK, clean immediately" can be given, and the device can perform an operation of cleaning of the living room.

In view of the basis of directional de-noising requiring determination of a direction of a sound source first, a horizontal angle and a vertical angle of a point of the sound source relative to the device can be determined, so that directional de-noising of the microphone array can be performed.

Figure 4:
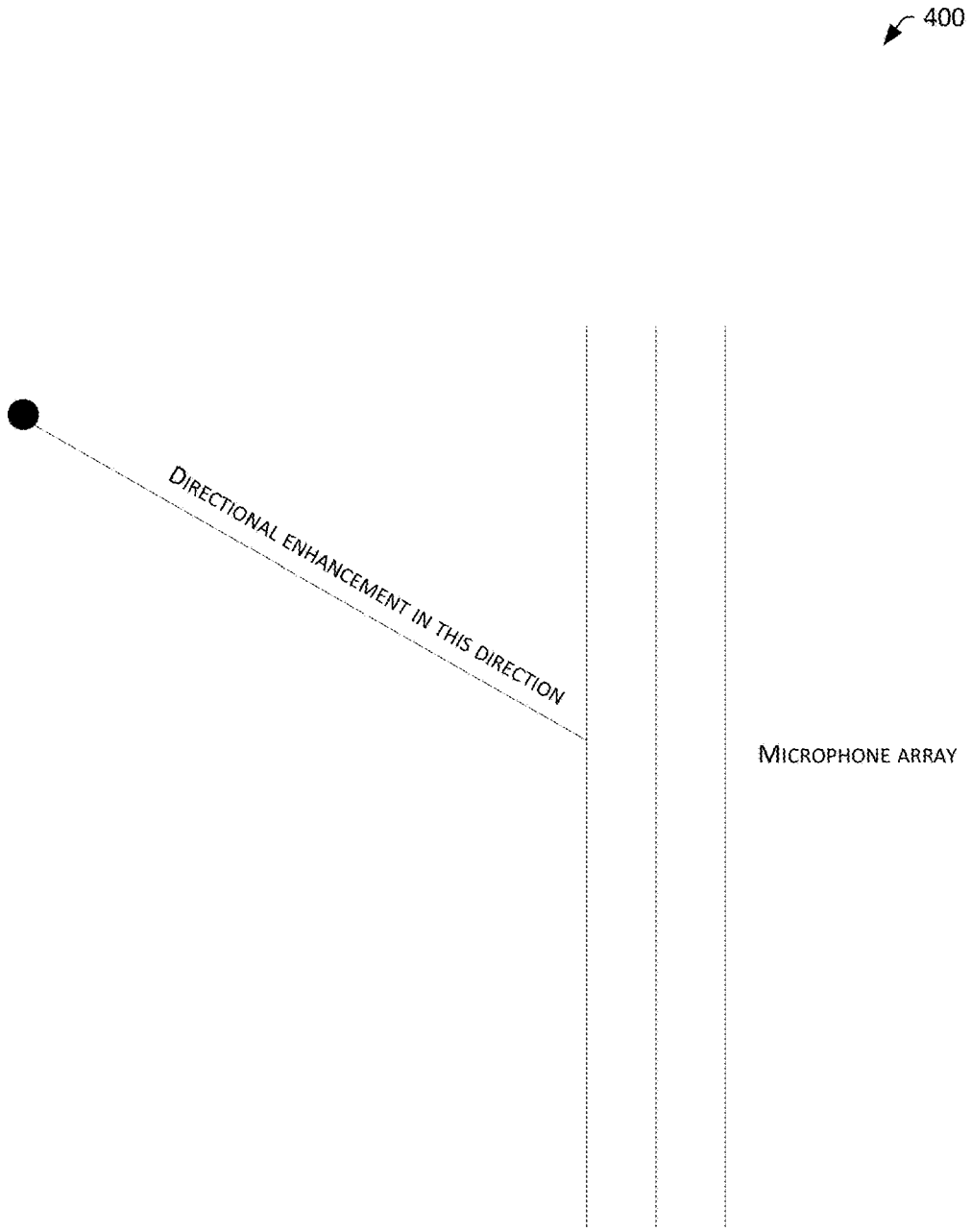
FIG. 4 is a schematic diagram of a directional de-noising principle in accordance with the embodiments of the present disclosure.

Specifically, during directional de-noising, sound in a source direction of the sound is directionally enhanced, and sound in directions other than a sound source is directionally suppressed as shown in FIG. 4. FIG. 4 shows a schematic diagram of a two-dimensional plane 400, and is directional de-noising in a three-dimensional space in practical implementations, in which a direction of sound enhancement in the three-dimensional space is to be determined.

Figure 5:
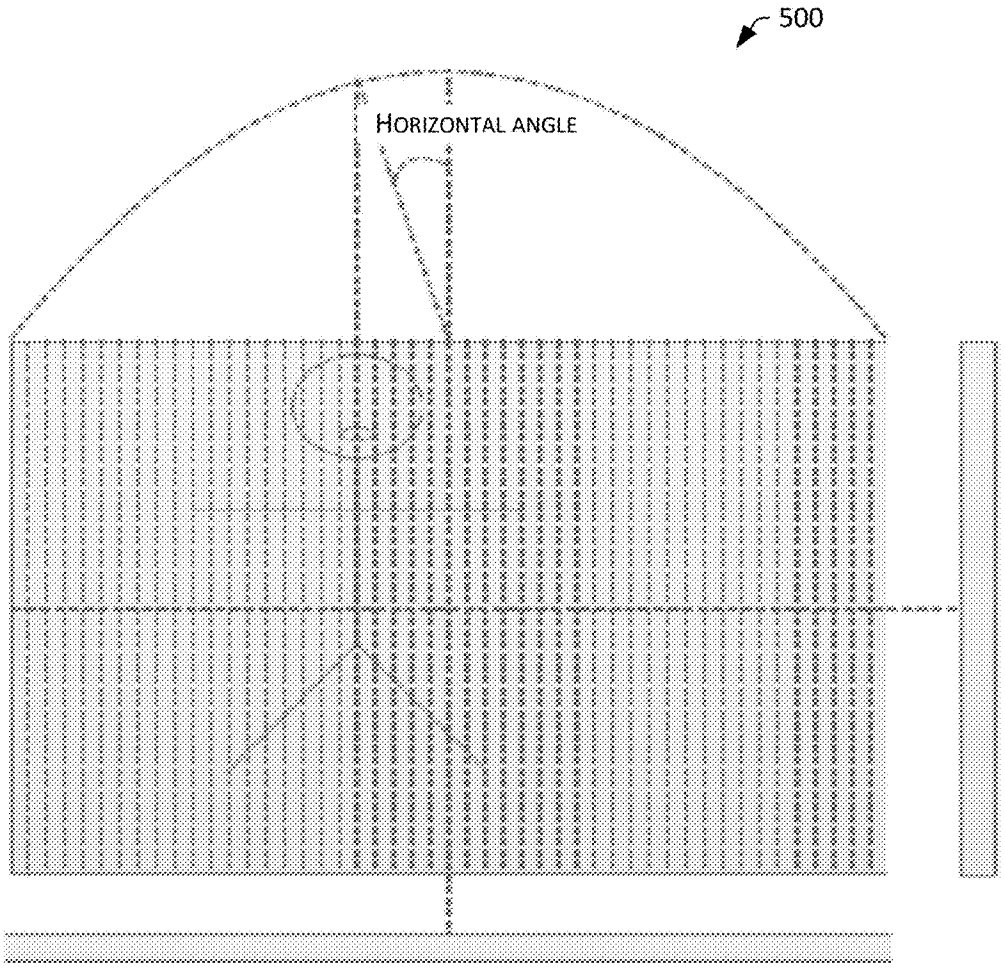
FIG. 5 is a schematic diagram of principles of determining a horizontal angle and a vertical angle in accordance with the embodiments of the present disclosure.

In this example, two methods of determining a direction of a sound source are provided. In other words, two exemplary methods for determining a horizontal angle and a vertical angle of a sounding portion of a target object with respect to the device are provided as follows:

1) As shown in FIG. 5, a viewing angle 500 of a camera forms an arc. The arc is then equally divided, and projections of equal diversion points on an imaging frame are used as scales. A scale in which a sounding portion of a target object is located on the imaging frame is determined, and angles corresponding to the determined scale are determined to be a horizontal angle and a vertical angle of the sounding portion with respect to the device.

2) A size of a marking area of a target object in an imaging frame is determined, wherein a sounding part is located in the marking area. A distance of the target object from a camera is determined according to the size of the marking area in the imaging frame. Based on the determined distance, a horizontal angle and a vertical angle of the sounding part relative to the device are calculated through an inverse trigonometric function.

However, it is worth noting that the above-mentioned determination of a horizontal angle and a vertical angle of a sounding part of a target object with respect to the device is only an exemplary description. In practical implementations, other methods of determining a horizontal angle and a vertical angle may also be used, which are not limited in the present disclosure.

In view of some relatively noisy places where a flow of people is relatively large and multiple people may be talking at the same time, directional de-noising to be performed on sound of which sound source(s) needs to be determined. Accordingly, determination can be made using voice content, i.e., determining which person is relevant to the device, thereby determining that such person is applying for the device, and directional de-noising can be performed on his/her voice. For example, a user faces towards a ticket vending machine of a subway and says: "read a book for a while, and order a takeaway". At this time, it can be recognized that the user is facing the device and speaks with his/her mouth. However, after a semantic analysis is performed on the recognized content "read a book for a while, and order a takeaway", the content is determined to be not relevant to the device. As such, a determination can be made that the content spoken by the user is not relevant to the device. The voice content of the user do not need to be obtained even though facing towards the device, and thus directional de-noising does not need to be performed on the voice in a voice direction of the user.

Voice content of a user that is obtained can be semantically analyzed, such that a corresponding response is made only when the device is related, and no response can be made if being not related to the device, the user is considered to be not establishing a voice interaction with the device. In this way, sound interference can be effectively avoided in a noisy environment.

In order to ensure the validity of voice interaction, voice data of a user may be obtained in response to determining that the user faces the device and is speaking through the mouth, or a time duration of the user facing the device exceeds a preset time duration. The data is semantically analyzed to determine whether the voice content is relevant to the device, and a final determination is made that the user is conducting a voice interaction with the device only after determining the voice content is relevant to the device, instead of determining that the user is conducting a voice interaction with the device as long as the user is facing the device and is talking through the mouth. In this way, misjudgment of voice interaction can be effectively avoided.

In view of some occasions in which multiple users are talking to the device together, and conversation contents thereof are relevant to the device and are consistent with conditions for voice interactions, a selection mechanism may be configured for the device in this case. For example, a configuration may be:

1) An object that is at the shortest linear distance from the device is taken as a sound source object;

2) A, object with the largest angle facing towards the device is taken as a sound source object.

However, it is worth noting that the above-mentioned selection method for selecting a voice of which user to perform directional de-noising is only an exemplary description. In practical implementations, other methods can be used for selection, which are not limited by the present disclosure.

By performing noise elimination processing, voice data that is obtained can be made more clearly, so that content that is expressed in the finally parsed voice is more accurate.

Taking into account that the normal life scene is generally noisy, the voice of the user that is received may be subjected to noise reduction processing in order to make the obtained voice data to be clear and accurate. Furthermore, in order to identify the meaning of the voice of the user to enable the device to make a corresponding responsive operation, the obtained voice of the user can be converted into text content, and a semantic analysis is performed thereon using a semantic understanding module to determine the content that is expressed by the voice of the user.

In implementations, user voice is received through a microphone array and directional de-noising is implemented through the microphone array. Specifically, the microphone array may be a directional microphone array or an omni-directional microphone array. If the microphone array is a directional microphone array, a receiving direction of the microphone can be adjusted to face a position of a sound source after the position of the sound source is determined. If the microphone array is an omni-directional microphone array, the omni-directional microphone array can be controlled to receive only sound in a specified direction.

Which type of microphone array is specifically selected may be selected according to actual needs, which is not limited in the present disclosure.

After a position and a orientation are determined, directional de-noising is performed on sound data, which may be a directional enhancement of sound in a direction of a sound source, or may be a directional suppression of sound in directions other than that of the sound source. Alternatively, directional enhancement is performed on the sound in the direction of the sound source, and the sound in directions other than that of the sound source is directionally suppressed. These types of methods can achieve the purpose of directional noise cancellation. In practical implementations, selection can be made according to actual needs.

In implementations, the voice interactive system may further include a server. The voice device communicates with the server. The voice server can process the received voice of the user therein. Alternatively, the received voice of the user can be transmitted to the server and processed by the server to generate a control command. The voice device is controlled to execute a voice response or perform a preset operation, etc., through the generated control command. Specifically, the process (i.e., determining whether to initiate a voice interaction and to identify the semantic of the voice of the user) may be implemented by the voice device itself or by the server, which is not limited in the present disclosure.

The above-mentioned voice interactive system can be applied to places and devices that can use voice for interactions, such as in a home, a conference hall, a car, an exhibition hall, a subway station, a railway station, etc., and can effectively enhance the interactive experience of users.

The above is to first determine a position of a sound source of sound data, and then to perform directional de-noising on the sound data according to the determined position of the sound source, so that sound in a direction of the sound source can be enhanced, and sound in other directions can be suppressed, thereby eliminating noises associated with the sound data. This solves the existing problem that noises cannot be effectively cancelled in a noisy environment, and achieves the technical effects of effectively suppressing noises and improving the accuracy of voice recognition.

The noise problem can be solved by a "visual+voice" method. A position of a sound source is obtained by a camera, and a directional de-noising is performed by a microphone array, thereby achieving the purpose of reducing noises.

The above voice interactive method will be described hereinafter in conjunction with a particular use scenario, and the method is used in a subway ticket vending machine of a subway as an example.

Figure 6:
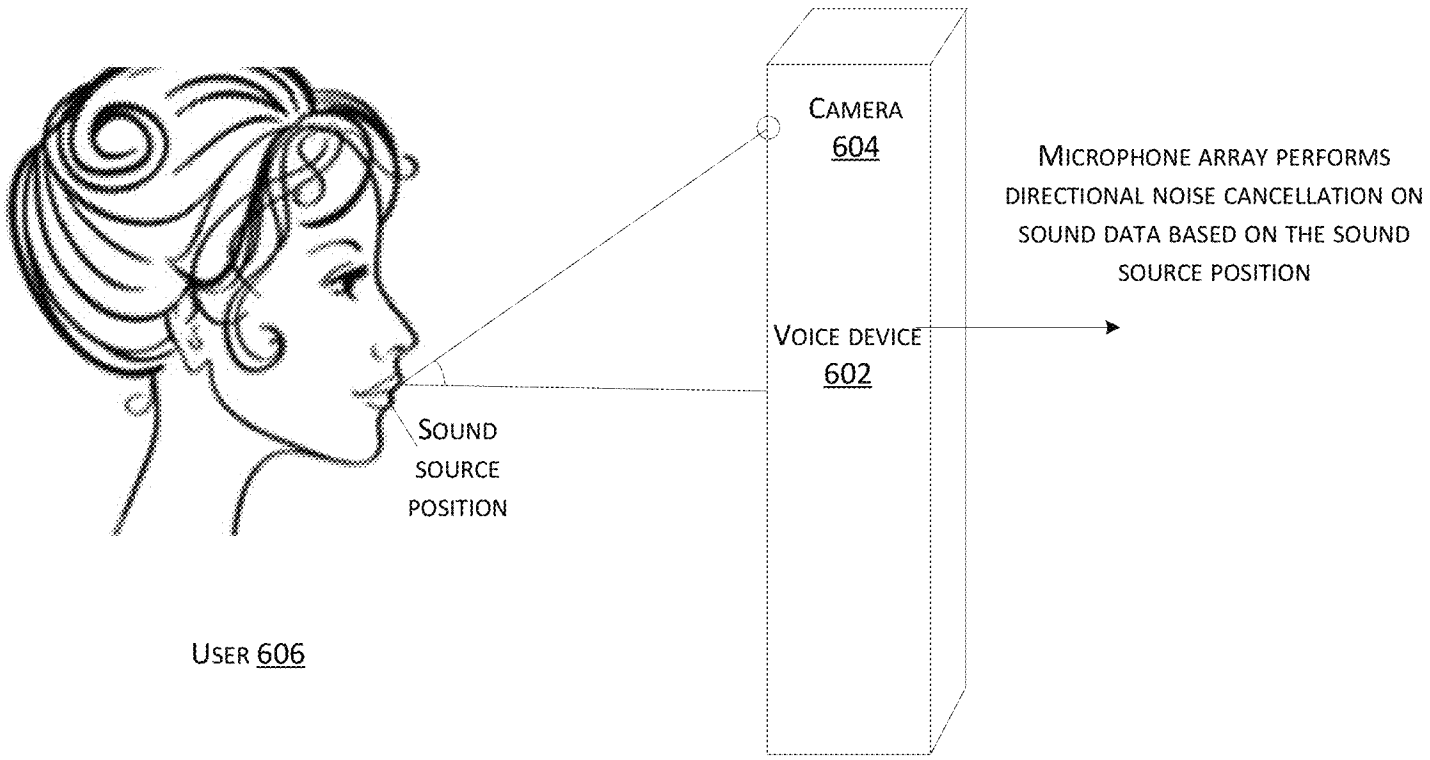
FIG. 6 is a schematic diagram of a scenario associated with purchasing a subway ticket in accordance with the embodiments of the present disclosure.

As shown in FIG. 6, the ticket vending machine 602 of the subway can be provided with a camera 604. Monitoring of whether someone 606 is facing the ticket vending machine 602 is made in real time through the camera 604. As such, a voice interaction can be established with such user 606. During a process of conducting voice interactions, directional de-noising is needed to be performed on voice data.

Scenario 1:

In response to detecting that a person is facing the ticket vending machine and speaks, a horizontal angle and a vertical angle of a position of a mouth of the speaking person with respect to a camera of the ticket vending machine can be obtained in this case. As such, the horizontal angle and the tile angle of the mouth relative to a microphone array can be determined, and so that directional de-noising can be performed on voice of the user.

For example, if the user says "I want to buy a subway ticket from Qinghe to Suzhou Street", then the microphone array can strengthen the sound in a direction of the user's mouth and suppress sound in directions other than that of the user's mouth, so that the device can receive voice data of "I want to buy a subway ticket from Qinghe to Suzhou Street" in a clearer manner, with less noise, which can improve the accuracy of recognition of the voice data.

Scenario 2:

A person is detected to be facing the ticket vending machine, and a time duration of the person facing the ticket vending machine is determined. When the time duration reaches a preset duration, a determination can be made that such user intends to purchase a ticket.

At this time, an establishment of voice interaction with the user can be triggered. For example, the user can be guided by voice or video to purchase a ticket, for example. Alternatively, the ticket vending machine may actively ask "Hello, where do you need to buy a subway ticket for". Thereafter, the microphone array can be controlled to strengthen the sound in a direction of the user's mouth and suppress sound in directions other than that of the user's mouth, so that the device can receive the voice of a response of the user in a clearer manner, with less noise, which can improve the accuracy of recognition of voice data.

Dialogues in different inquiry scenarios when a subway ticket is purchased are used as examples.

Dialogue 1 (a Fast Ticket Purchasing Process):

A user walks to the front of a ticket vending machine of Shanghai Railway Station. A camera of the ticket vending machine captures that a person is facing towards the device, and a time duration of stay exceeds a preset duration. A determination can be made that the user is intended to use the device to purchase a ticket. At this time, the ticket vending machine can actively trigger a process of purchasing a ticket, and inquiry the user, thus eliminating the need to be woken up by the user and avoiding a learning process on the device by the user. For example, Ticket vending machine: Hello, please tell me your destination and number of tickets. (this greeting and question-and-answer approach can be pre-configured by dialogue management).

User: I want a ticket to People's Square.

After obtaining "I want a ticket to People's Square" submitted by the user, the ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that information about the "destination" and the "number of tickets" has been carried therein, and therefore can determine that information required for making a ticket purchase has been satisfied. Accordingly, the next conversation content can be determined to be telling the user an amount that needs to be paid.

The ticket vending machine can display or voice broadcast: (ticket details) a total of 5 dollars, please scan the code to pay.

The user pays the fare through a response APP scan code such as Alipay, etc. After confirming that the fare has been paid, the ticket vending machine can execute a ticket issuing process and issue a subway ticket to People's Square.

Dialogue 2 (a Ticket Purchasing Process that Requires an Injury about the Number of Tickets):

A user walks to the front of a ticket vending machine of Shanghai Railway Station. A camera of the ticket vending machine captures that a person is facing the device, and a time duration of stay exceeds a preset duration. A determination can be made that the user is intended to use the device to purchase a ticket. At this time, the ticket vending machine can actively trigger a ticket purchasing process, and ask the user, thus eliminating the need to be woken up by the user and avoiding a learning process on the device by the user. For example, Ticket vending machine: Hello, please tell me your destination and number of tickets.

User: I want to go to People's Square.

After obtaining "I want to go to People's Square" submitted by the user, the ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that only information about the "destination" is carried, and information about the "number of tickets" is still missing. Therefore, the dialog management can be invoked to generate the next question, asking the user for the number of tickets needed.

Ticket vending machine: The fare to People's Square is 5 dollars, how many tickets do you want to buy?

User: 2 tickets.

After obtaining "2 tickets" submitted by the user, the ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that two pieces of information, namely, the "destination" and the "number of tickets", have appeared, and therefore can determine that information required for making a ticket purchase has been satisfied. Accordingly, the next conversation content can be determined to be telling the user an amount that needs to be paid.

Ticket vending machine: (show ticket details) a total of 10 dollars, please scan the code to pay.

The user pays the fare through a response APP scan code such as Alipay, etc. After confirming that the fare has been paid, the ticket vending machine can execute a ticket issuing process and issue 2 subway tickets to People's Square.

Dialogue 3 (a Ticket Purchasing Process with Interrupted Dialogue):

A user walks to the front of a ticket vending machine of Shanghai Railway Station. A camera of the ticket vending machine captures that a person is facing the device, and a time duration of stay exceeds a preset duration. A determination can be made that the user is intended to use the device to purchase a ticket. At this time, the ticket vending machine can actively trigger a ticket purchasing process, and ask the user, thus eliminating the need to be woken up by the user and avoiding a learning process on the device by the user. For example, Ticket vending machine: Hello, please tell me your destination and number of tickets.

User: I want to go to People's Square.

After obtaining "I want to go to People's Square" submitted by the user, the ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that only information about the "destination" is carried in the voice information, and information about the "number of tickets" is still missing. Therefore, the dialog management can be invoked to generate the next question, asking the user for the number of tickets needed.

Ticket vending machine: The fare to People's Square is 5 dollars, how many tickets do you want to buy?

User: No, I would like to go to Shaanxi South Road instead.

After obtaining "No, I would like to go to Shaanxi South Road instead" submitted by the user, the ticket vending machine can recognize voice data. First, voice recognition is performed, and content carried in the voice is recognized. Semantic recognition is then performed to recognize that the intent of the voice and information carried herein is not about the number of tickets, but a modification of the destination. Therefore, it is determined that the user wants to go not to Shaanxi South Road instead of People's Square. As such, the destination can be modified to "Shaanxi South Road". Further, the recognized content can be sent to the dialog management. The dialog management determines that only destination information is present, and information about the "number of tickets" is still missing. Therefore, the dialog management can be invoked to generate the next question to the user, asking the number of tickets required.

Ticket vending machine: Ok, the fare to Shaanxi South Road is 6 dollars. How many tickets do you want to buy?

User: 2 tickets.

After obtaining "2 tickets" submitted by the user, the ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that two pieces of information, namely, the "destination" and the "number of tickets", have appeared, and therefore can determine that information required for making a ticket purchase has been satisfied. Accordingly, the next conversation content can be determined to be telling the user an amount that needs to be paid.

Ticket vending machine: (show ticket details) a total of 10 dollars, please scan the code to pay.

The user pays the fare through a response APP scan code such as Alipay, etc. After confirming that the fare has been paid, the ticket vending machine can execute a ticket issuing process and issue 2 subway tickets to Shaanxi South Road.

Dialogue 4 (Recommendations for Lines and Subway Lines):

A user walks to the front of a ticket vending machine of Shanghai Railway Station. A camera of the ticket vending machine captures that a person is facing the device, and a time duration of stay exceeds a preset duration. A determination can be made that the user is intended to use the device to purchase a ticket. At this time, the ticket vending machine can actively trigger a ticket purchasing process, and ask the user, thus eliminating the need to be woken up by the user and avoiding a learning process on the device by the user. For example, Ticket vending machine: Hello, please tell me your destination and number of tickets.

User: I want to go to Metro Hengtong Building.

After obtaining the "I want to go to Metro Hengtong Building" submitted by the user, the ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that the "destination" information has been carried therein. Conversation content of a route notification is configured in the dialog management module. After the destination is obtained, route information corresponding to the destination can be matched and given to the user. Therefore, subway buffer information that is determined can be provided to the user in a form of a dialogue or an information display, for example:

Ticket vending machine: (showing a target map) You are recommended to take Line Number 1, get off at Hanzhong Road Station, and take exit 2.

User: Ok, buy one ticket.

The ticket vending machine can recognize voice data. First, voice recognition is performed, and the content carried by the voice is recognized. Semantic recognition is then performed to recognize the intent of this piece of voice and information carried therein. Further, the recognized content can be sent to the dialog management, and the dialog management determines that two pieces of information, namely, the "destination" and the "number of tickets", have appeared, and therefore can determine that information required for making a ticket purchase has been satisfied. Accordingly, the next conversation content can be determined to be telling the user an amount that needs to be paid.

Ticket vending machine: (show ticket details) a total of 5 dollars, please scan the code to pay.

The user pays the fare through a response APP scan code such as Alipay, etc. After confirming that the fare has been paid, the ticket vending machine can execute a ticket issuing process and issue one ticket to Hengtong Building.

It is worth noting that the above description is only an exemplary description of dialogues in scenarios. Other dialogue modes and processes may be adopted in practical implementations, which are not limited in the present disclosure.

However, further considering such relatively noisy environment as a subway station having a relatively large number of people, voice data can be obtained through directional de-noising when acquiring the voice data. If a large number of people are recognized to satisfy preset conditions for establishing a voice interaction, a user who is facing towards the ticket vending machine and is at the shortest linear distance from the ticket vending machine can be selected to be a user for establishing a voice interaction, thereby avoiding the difficulties of deciding which user to establish a voice interaction therewith in cases of having multiple users.

It is worth noting that the above only uses an application in a subway station as an example for illustration. The method can also be applied to other smart devices, such as household sweeping robots, self-service shops, consulting devices, railway stations, self-service vending machines, etc. The present disclosure does not have any specific limitations on specific scenarios, which may be selected and set according to actual needs.

Figure 7:
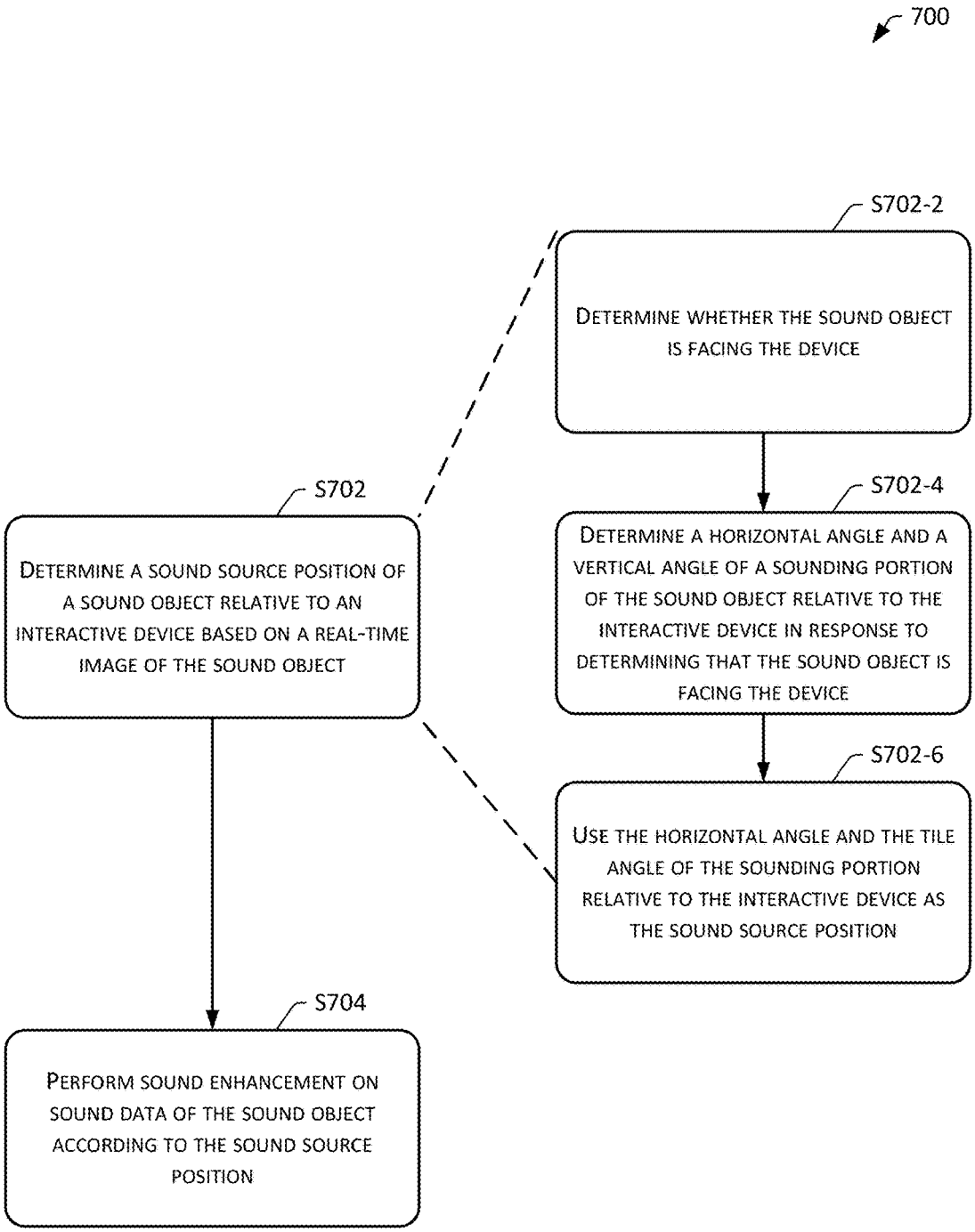
FIG. 7 is a process flowchart of a sound processing method in accordance with the embodiments of the present disclosure.

FIG. 7 is a flowchart of a sound processing method 700 according to a method embodiment of the present disclosure. Although the present disclosure provides operational steps of methods or structures of apparatuses as shown in the following embodiments or figures, more or fewer operational steps or modular units may be included in the methods or apparatuses based on conventional or non-inventive effort. In steps or structures without an existence of any necessary causal relationship therebetween in a logical sense, orders of execution of the steps or modular structures of the apparatuses are not limited to the orders of execution or the modular structures shown in the description of the embodiments and the drawings of the present disclosure. When the methods or modular structures are applied in a device or terminal product in practice, execution may be sequentially performed according to the methods or the modular structures shown in the embodiments or the figures or in parallel (for example, a parallel processor or multi-thread processing environment, even a distributed processing environment).

Specifically, as shown in FIG. 7, a sound processing method 700 provided by the embodiments of the present disclosure may include:

S702: Determine a sound source position of a sound object relative to an interactive device based on a real-time image of the sound object.

Specifically, determining the sound source location of the sound object relative to the interactive device based on the real-time image of the sound object may include:

S702-2: Determine whether the sound object is facing the device.

S702-4: Determine a horizontal angle and a vertical angle of a sounding portion of the sound object relative to the interactive device in response to determining that the sound object is facing the device.

S702-6: Use the horizontal angle and the tile angle of the sounding portion relative to the interactive device as the sound source position.

In S702-4, the horizontal angle and the vertical angle of the sounding portion of the target object with respect to the device may be determined by, but not limited to, at least one of the following ways:

Method 1) Forming an arc from a viewing angle of a camera forms; equally dividing the arc, and using projections of equal diversion points on an imaging frame as scales; and determining a scale in which a sounding portion of a target object is located on the imaging frame, and determining angles corresponding to the determined scale as a horizontal angle and a vertical angle of the sounding portion with respect to the device.

Method 2) Determining a size of a marking area of a target object in an imaging frame, wherein a sounding part is located in the marking area; determining a distance of the target object from a camera according to the size of the marking area in the imaging frame; and calculating a horizontal angle and a vertical angle of the sounding part relative to the device through an inverse trigonometric function based on the determined distance.

The horizontal angle and the tile angle of the sounding portion relative to the device is treated as the sound source position, and directional enhancement is performed on the sound.

S704: Perform sound enhancement on sound data of the sound object according to the sound source position.

When directional de-noising is performed, the directional de-noising may be performed through a microphone array. Specifically, the microphone array can directionally enhance the sound from the sound source position, determine the horizontal position and the vertical position of the sounding portion of the target object with respect to the device, and directionally suppress the sound from positions other than the sound source position.

The microphone array described above may include, but is not limited to, at least one of the following: a directional microphone array, an omni-directional microphone array.

In view of noisy environments which often have a large number of people, rules for selecting which target object as a source object can be configured in cases of multiple target objects. For example, 1) An object that is at the shortest linear distance from the device is used as a sound source object.

2) An object with the largest angle facing towards the device is used as a sound source object.

Figure 8:
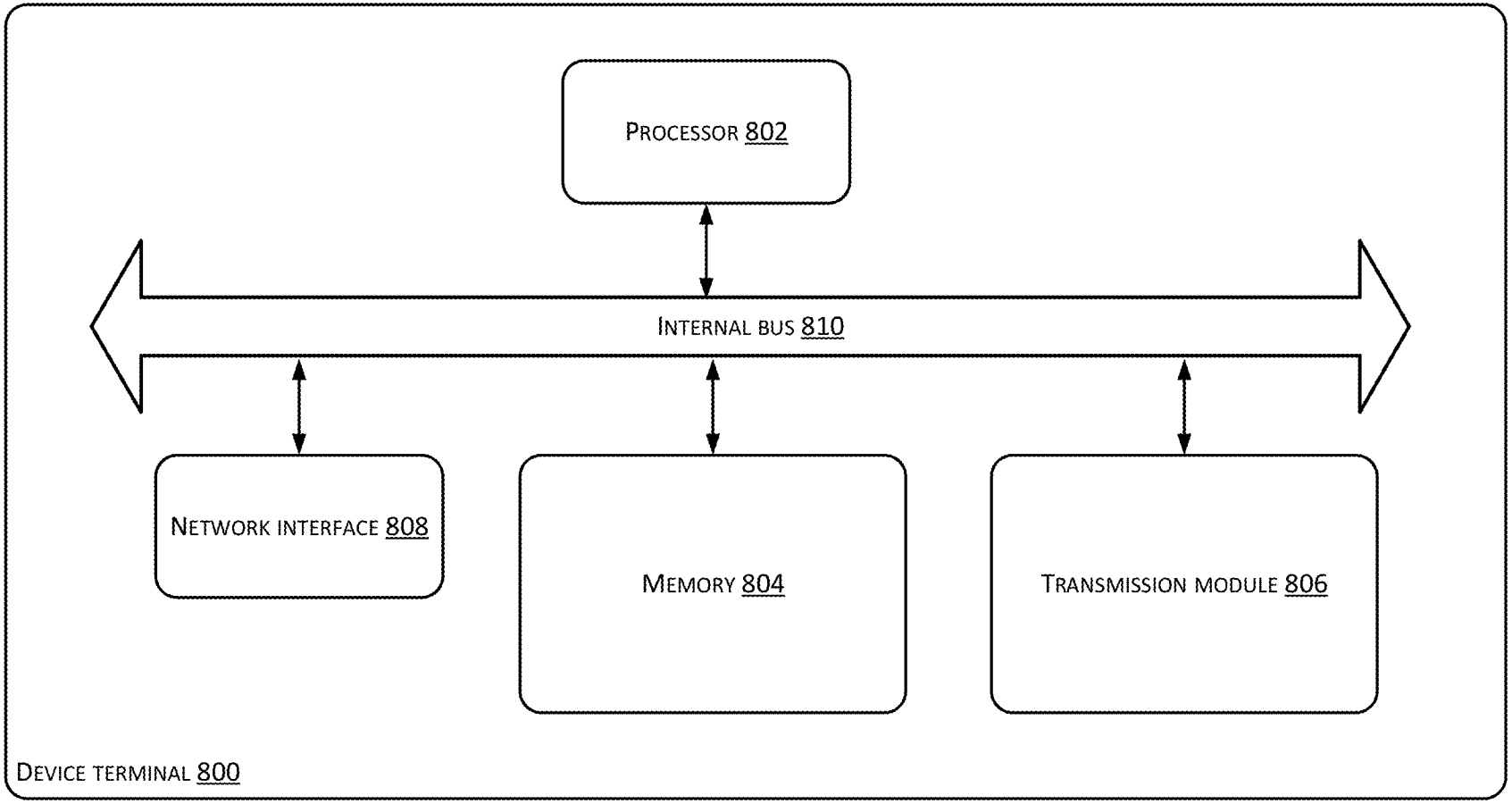
FIG. 8 is a schematic structural diagram of a terminal device in accordance with the embodiments of the present disclosure.

The method embodiments provided by the present disclosure can be implemented in a mobile terminal, a computer terminal, a computing apparatus, or the like. A computer terminal is used as an example. FIG. 8 is a structural block diagram of hardware of a device terminal 800 for an interactive method according to the embodiments of the present invention. As shown in FIG. 8, a device terminal 800 may include one or more (only one of which is shown in the figure) processors 802 (the processor 802 may include, but is not limited to, a processing device such as a microprocessor (MCU) or a programmable logic device (FPGA)), memory 804 used for storing data, and a transmission module 806 used for communication functions. In implementations, the device terminal 800 may further include a network interface 808 used for connecting the device terminal 800 to one or more networks such as the Internet, and an internal bus 810 connecting different components (such as the processor 802, the memory 804, the transmission module 806, and the network interface 808) with one another. One skilled in the art can understand that the structure shown in FIG. 8 is merely illustrative and does not have any limitations on a structure of the above electronic device. For example, the device terminal 800 may also include more or fewer components than the ones shown in FIG. 8, or have a different configuration than the one shown in FIG. 8.

The memory 802 can be configured to store software programs and modules of application software, such as program instructions/modules corresponding to the data interactive method(s) in the embodiment(s) of the present invention. The processor 802 executes various functions, applications and data processing by running software program(s) and module(s) stored in the memory 804, i.e., implementing the data interactive method(s) of the above application program(s). The memory 804 may include high speed random access memory and may also include non-volatile memory such as one or more magnetic storage devices, flash memory, or other non-volatile solid-state memory. In some examples, the memory 804 may further include storage devices that are remotely located relative to the processor 802. These storage devices may be coupled to the computer terminal 800 via a network. Examples of the network include, but are not limited to, the Internet, an intranet, a local area network, a mobile communication network, and a combination thereof.

The transmission module 806 is configured to receive or transmit data via a network. Specific examples of the network may include a wireless network provided by a communication provider of the computer terminal 800. In an example, the transmission module 806 includes a Network Interface Controller (NIC) that can be connected to other network devices through a base station and thereby communicate with the Internet. In an example, the transmission module 806 can be a Radio Frequency (RF) module, which is used for conducting communications with the Internet wirelessly.

Figure 9:
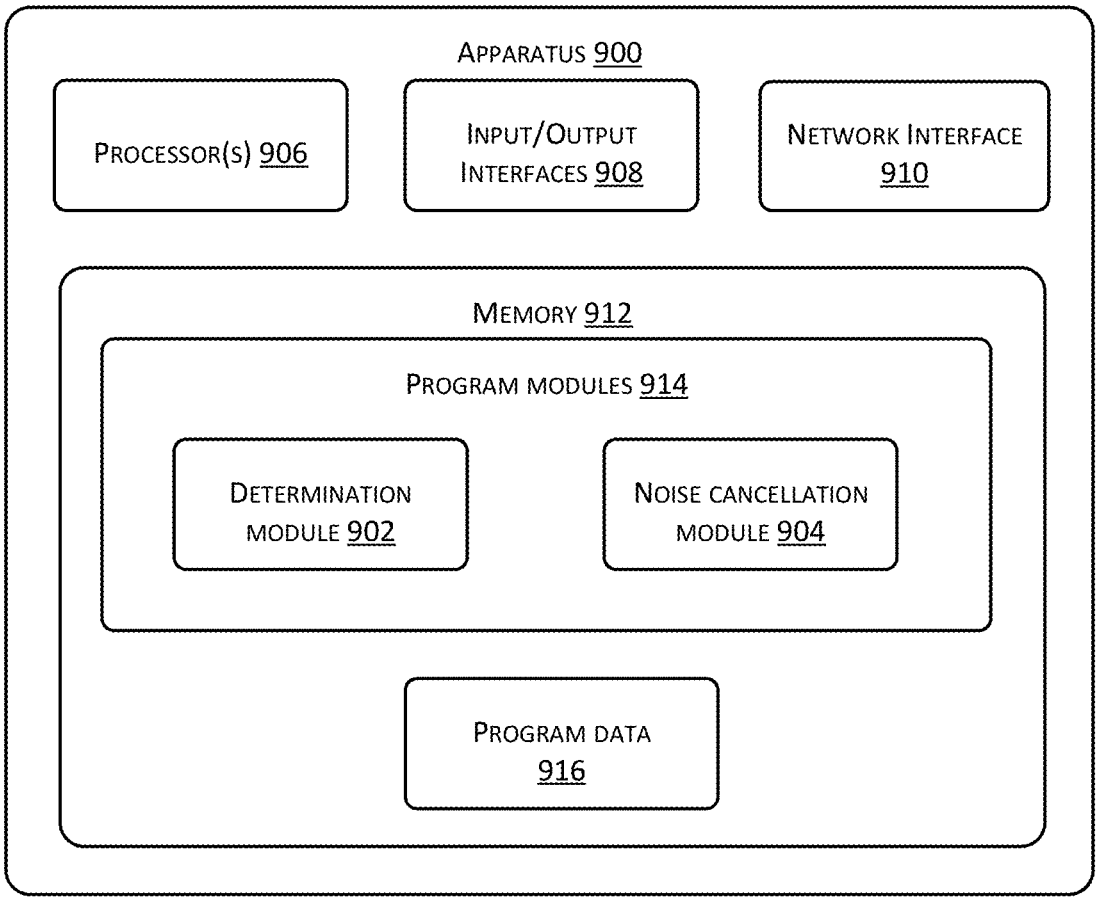
FIG. 9 is a structural block diagram of a sound processing apparatus in accordance with the embodiments of the present disclosure.

FIG. 9 is a structural block diagram of a sound processing apparatus 900. In implementations, the apparatus 900 may include one or more computing devices. In implementations, the apparatus 900 may be a part of one or more computing devices, e.g., implemented or run by the one or more computing devices. In implementations, the one or more computing devices may be located in a single place or distributed among a plurality of network devices over a network. By way of example and not limitation, the apparatus 900 may include a determination module 902 and a noise cancellation module 904.

The determination module 902 is configured to determine a sound source location of a sound object relative to an interactive device based on a real-time image of the sound object.

The noise cancellation module 904 is configured to perform a sound enhancement on sound data of the sound object according to the sound source position.

In implementations, determining the sound source location of the sound object relative to the interactive device based on a real-time image of the sound object may include determining whether the sound object is facing the device; determining a horizontal angle and a vertical angle of a sounding portion of the sound object with respect to the interactive device in response to determining that the sound object is facing the device; and setting the horizontal angle and the vertical angle of the sounding portion relative to the interactive device as the sound source position.

In implementations, determining the horizontal angle and the vertical angle of the sounding portion of the sound object relative to the interactive device may include forming a viewing angle of the camera as an arc; equally dividing the arc, and using projections of equal diversion points on an imaging frame as scales; and determining a scale in which a sounding portion of a target object is located on the imaging frame, and determining angles corresponding to the determined scale as a horizontal angle and a vertical angle of the sounding portion relative to the device.

In implementations, determining the horizontal angle and the vertical angle of the sounding portion of the sound object relative to the interactive device may include determining a size of a marking area of a target object in an imaging frame, wherein a sounding part is located in the marking area; determining a distance of the target object from a camera according to the size of the marking area in the imaging frame; and calculating the horizontal angle and the vertical angle of the sounding part relative to the device through an inverse trigonometric function based on the determined distance.

In implementations, performing the sound enhancement on sound data of the sound object according to the sound source position may include performing a directional enhancement on sound from the sound source position; and performing a directional suppression on sound from positions other than the sound source position.

In implementations, performing the sound enhancement on sound data of the sound object according to the sound source position may include performing directional denoising on the sound data through a microphone array.

In implementations, the microphone array may include, but is not limited to, at least one of the following: a directional microphone array, an omni-directional microphone array.

In implementations, determining the sound source location of the sound object relative to the interactive device based on the real-time image of the sound object may include determining the sound object of the sound data according to one of the following rules in cases that a plurality of objects make sound: treating an object that is at the shortest linear distance from the device as the sound object; and treating an object with the largest angle facing towards the device as the sound object.

In implementations, the apparatus 900 may further include one or more processors 906, an input/output (I/O) interface 908, a network interface 910, and memory 912.

The memory 912 may include a form of computer readable media such as a volatile memory, a random access memory (RAM) and/or a non-volatile memory, for example, a read-only memory (ROM) or a flash RAM. The memory 912 is an example of a computer readable media.

The computer readable media may include a volatile or non-volatile type, a removable or non-removable media, which may achieve storage of information using any method or technology. The information may include a computer-readable instruction, a data structure, a program module or other data. Examples of computer storage media include, but not limited to, phase-change memory (PRAM), static random access memory (SRAM), dynamic random access memory (DRAM), other types of random-access memory (RAM), read-only memory (ROM), electronically erasable programmable read-only memory (EEPROM), quick flash memory or other internal storage technology, compact disk read-only memory (CD-ROM), digital versatile disc (DVD)

or other optical storage, magnetic cassette tape, magnetic disk storage or other magnetic storage devices, or any other non-transmission media, which may be used to store information that may be accessed by a computing device. As defined herein, the computer readable media does not include transitory media, such as modulated data signals and carrier waves.

In implementations, the memory 912 may include program modules 914 and program data 916. The program modules 914 may include one or more of the modules as described in the foregoing description and shown in FIG. 9.

Figure 10:
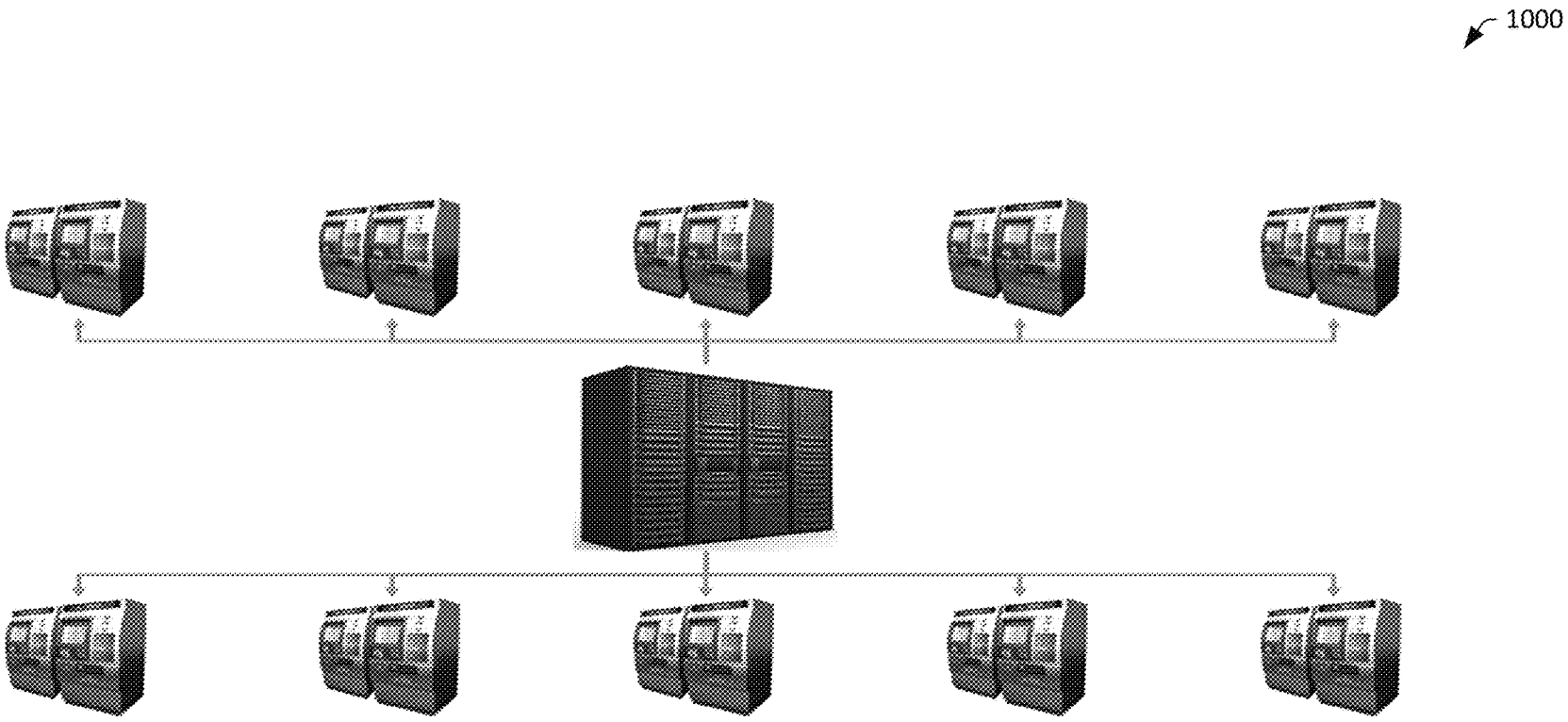
FIG. 10 is a schematic diagram of architecture of a centralized deployment approach in accordance with the embodiments of the present disclosure.
Figure 11:
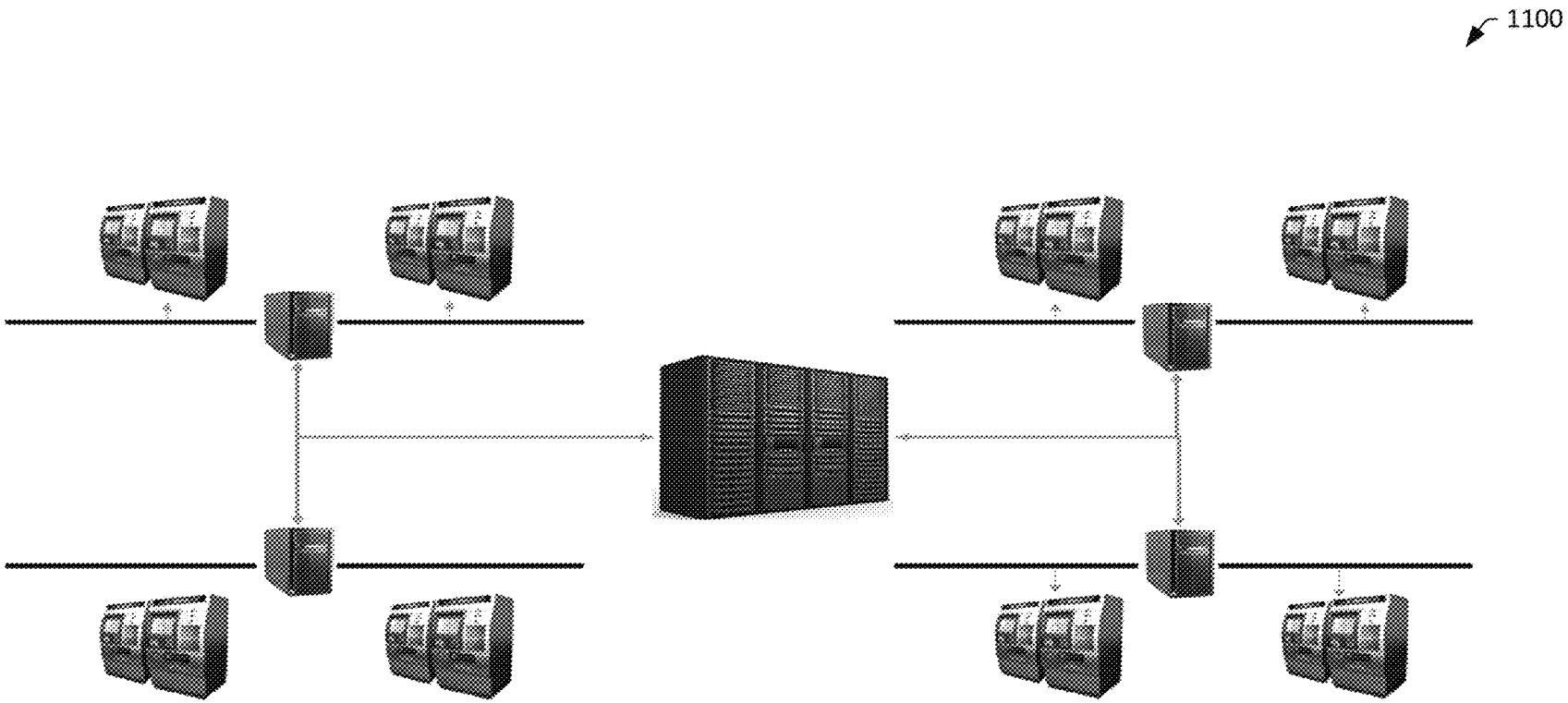
FIG. 11 is a schematic diagram of architecture of a large centralized and small dual active deployment approach in accordance with the embodiments of the present disclosure.

For some large-scale voice interaction scenarios or payment scenarios, two deployment modes are provided in this example. FIG. 10 shows a centralized deployment mode 1000, i.e., multiple human-machine interactive devices are respectively connected to a same processing center. The processing center may be a cloud server, a server cluster, or the like, and the processing center may perform processing on data, or centralized control of the human-machine interactive devices. FIG. 11 shows a large centralized and small dual active deployment mode 1100, in which every two human-machine interactive devices are connected to a small processing center, and the small processing center controls these two human-machine interactive devices connected thereto. All small processing centers are connected to a same large processing center, and a centralized control is performed through the large processing center.

However, it is worth noting that the deployment methods listed above are only an exemplary description. In practical implementations, other deployment methods may also be adopted. For example, a large centralized and triple active deployment mode, etc., and the number of human-computer interactive devices connected to each small processing center being not equal, and the like, can be used as alternative deployment modes, and can be selected according to actual needs, which are not limited in the present disclosure.

The human-computer interactive systems and methods, and the voice de-noising methods, etc., that are provided in the present disclosure can be applied to service situations such as court trials, customer service's quality inspections, live video broadcasts, journalist's interviews, meeting minutes, doctor's consultations, etc., and can be applied in customer service machines, smart financial investment consultants, various types of APP, or all kinds of intelligent hardware devices, such as mobile phones, speakers, set-top boxes, vehicle-mounted devices, etc. What needs to be involved are audio recording file recognition, real-time voice recognition, text big data analysis, short voice recognition, speech synthesis, intelligent dialogue, and so on.

In the above examples, after determining a position of a sound source of sound data, the voice de-noising methods and apparatuses perform directional de-noising on the sound data according to the determined sound source position, so that sound in a direction of the sound source is enhanced, and sound in other directions is suppressed. This thereby eliminates noises associated with the sound data, and solves the existing problem that noises cannot be effectively cancelled in a noisy environment, thus achieving the technical effects of effectively suppressing the noises and improving the accuracy of voice recognition.

Although the present disclosure provides operations of methods as described in the embodiments or flowcharts, more or fewer operations may be included based on routine or non-creative effort. The orders of operations recited in the embodiments are merely ones of many orders of execution of the operations, and do not represent unique orders of execution. Execution may be performed sequentially according to the methods shown in the embodiments or the drawing or in parallel (for example, a parallel processor or multi-thread processing environment), when executed by a device or a client product in practice.

The apparatuses or modules illustrated in the above embodiments may be implemented by a computer chip or an entity, or by a product having certain functions. For the convenience of description, the above apparatuses are divided into various modules in terms of functions for separate descriptions. Functions of the various modules may be implemented in one or more software and/or hardware components when the present disclosure is implemented. Apparently, a module that implements a certain function may also be implemented by a combination of a plurality of sub-modules or subunits.

The methods, apparatuses, or modules described in the present disclosure can be implemented in a form of computer readable program codes. A controller can be implemented in any suitable manner. For example, a controller can take a form of, for example, microprocessors or processors and computer readable media storing computer readable program codes (e.g., software or firmware) executed by the (micro)processors, logic gates, switches, application specific integrated circuits (ASICs), programmable logic controllers, and embedded microcontrollers. Examples of controllers include, but are not limited to, the following microcontrollers: ARC 625D, Atmel AT91SAM, Microchip PIC18F26K20, and Silicone Labs C8051F320. A memory controller can also be implemented as a part of control logic of the memory. It will also be apparent to one skilled in the art that logical programming can be performed completely using operations of the method(s) to cause the controller to implement the same functions in a form of logic gates, switches, application specific integrated circuits, programmable logic controllers, and embedded microprocessors, etc., in addition to implementing the controller in a form of purely computer readable program codes. Therefore, such type of controller can be considered as a hardware component, and an internal apparatus used for implementing various functions can also be regarded as a structure within a hardware component. Alternatively, even an apparatus used for implementing various functions can be considered as a software module and a structure within a hardware component that can implement the method(s).

Some modules in the apparatuses described in the present disclosure may be described in the general context of computer-executable instructions executed by a computer, such as program modules. Generally, program modules include routines, programs, objects, components, data structures, classes, etc., that perform designated tasks or implement designated abstract data types. The present disclosure can also be practiced in a distributed computing environment in which tasks are performed by remote processing devices that are connected through a communication network. In a distributed computing environment, program modules can be located in both local and remote computer storage media including storage devices.

It will be apparent to one skilled in the art from the above description of the embodiments that the present disclosure can be implemented by means of software plus necessary hardware. Based on such understanding, the essence of technical solutions of the present disclosure or the parts that make contributions to the existing technologies may be manifested in a form of a software product, or may be manifested in an implementation process of data migration. The computer software product may be stored in a storage media, such as ROM/RAM, a magnetic disk, an optical disk, etc., and includes a plurality of instructions for causing a computing device (which may be a personal computer, a mobile terminal, a server, or a network device, etc.) to execute the method described in each embodiments or a part of the embodiment.

The various embodiments in the specification are described in a progressive manner, and the same or similar parts between the various embodiments may be referenced to each other. Each embodiment put an emphasis on an area that is different from those of other embodiments. All or part of the present disclosure can be used in a number of general purpose or special purpose computer system environments or configurations, such as a personal computer, a server computer, a handheld device or portable device, a tablet device, a mobile communication terminal, a multiprocessor system, a microprocessor-based system, a programmable electronic device, a network PC, a small-scale computer, a mainframe computer, a distributed computing environment that includes any of the above systems or devices, etc.

Although the present disclosure has been described using the embodiments, one of ordinary skill in the art understands that a number of variations and modifications exist in the present disclosure without departing the spirit of the present disclosure. The appended claims are intended to include these variations and modifications without departing the spirit of the present disclosure.

The present disclosure can be further understood using the following clauses.

Clause 1: A sound processing method comprising: determining a sound source position of a sound object relative to an interactive device based on a real-time image of the sound object; and performing a sound enhancement on sound data of the sound object based on the sound source position.

Clause 2: The method of Clause 1, wherein determining the sound source position of the sound object relative to the interactive device based on the real-time image of the sound object comprises: determining whether the sound object is facing the device; determining a horizontal angle and a vertical angle of a sounding portion of the sound object with respect to the interactive device in response to determining that the sound object is facing the device; and setting the horizontal angle and the vertical angle of the sounding portion with respect to the interactive device as the sound source position.

Clause 3: The method of Clause 2, wherein determining the horizontal angle and the vertical angle of the sounding portion of the sound object relative to the interactive device comprises: forming a viewing angle of the camera as an arc; equally dividing the arc, and using projections of equal diversion points on an imaging frame as scales; and determining a scale in which a sounding portion of a target object is located on the imaging frame, and determining angles corresponding to the determined scale as a horizontal angle and a vertical angle of the sounding portion with respect to the device Clause 4: The method of Clause 2, wherein determining the horizontal angle and the vertical angle of the sounding portion of the sound object relative to the interactive device comprises: determining a size of a marking area of a target object in an imaging frame, wherein a sounding part is located in the marking area; determining a distance of the target object from a camera according to the size of the marking area in the imaging frame; and calculating the horizontal angle and the vertical angle of the sounding part relative to the device through an inverse trigonometric function based on the determined distance.

Clause 5: The method of Clause 1, wherein performing the sound enhancement on the sound data of the sound object based on the sound source position comprises: performing a directional enhancement on sound from the sound source position; and performing a directional suppression on sound from positions other than the sound source position.

Clause 6: The method of Clause 1, wherein performing the sound enhancement on the sound data of the sound object based on the sound source position comprises performing directional de-noising on the sound data through a microphone array.

Clause 7: The method of Clause 6, wherein the microphone array comprises at least one of: a directional microphone array, or an omni-directional microphone array.

Clause 8: The method of Clause 1, wherein determining the sound source position of the sound object relative to the interactive device based on the real-time image of the sound object comprises determining the sound object of the sound data according to one of the following rules in cases that a plurality of objects make sound: treating an object that is at the shortest linear distance from the device as the sound object; or treating an object with the largest angle facing towards the device as the sound object.

Clause 9: An interactive device comprising a processor and memory configured to store processor executable instructions, the processor executable instructions that, when executed, implement the method of any one of Clauses 1-8.

Clause 10: An interactive device comprising: a camera; a processor; and a microphone array, wherein: the camera configured to obtain a real-time image of a sound object; the processor configured to determine a sound source position of the sound object relative to the interactive device; and the microphone array configured to perform a sound enhancement on sound data of the sound object according to the sound source position.

Clause 11: The device of Clause 10, wherein the processor determining the sound source position of the sound object relative to the interactive device based on the real-time image of the sound object comprises: determining whether the sound object is facing the device; determining a horizontal angle and a vertical angle of a sounding portion of the sound object relative to the interactive device in response to determining that the sound object is facing the device; and setting the horizontal angle and the vertical angle of the sounding portion relative to the interactive device as the sound source position.

Clause 12: The device of Clause 11, wherein the processor determining the horizontal angle and the vertical angle of the sounding portion of the sound object relative to the interactive device comprises: forming a viewing angle of the camera as an arc; equally dividing the arc, and using projections of equal diversion points on an imaging frame as scales; and determining a scale in which a sounding portion of a target object is located on the imaging frame, and determining angles corresponding to the determined scale as the horizontal angle and the vertical angle of the sounding portion relative to the device.

Clause 13: The device of Clause 11, wherein the processor determining the horizontal angle and the vertical angle of the sounding portion of the sound object relative to the interactive device comprises: determining a size of a marking area of a target object in an imaging frame, wherein a sounding part is located in the marking area; determining a distance of the target object from a camera according to the size of the marking area in the imaging frame; and calculating the horizontal angle and the vertical angle of the sounding part relative to the device through an inverse trigonometric function based on the determined distance.

Clause 14: The device of Clause 10, wherein the processor performing the sound enhancement on the sound data of the sound object according to the sound source position comprises: performing a directional enhancement on sound from the sound source position; and performing a directional suppression on sound from positions other than the sound source position.

Clause 15: The device of Clause 10, wherein the processor performing the sound enhancement on the sound data of the sound object according to the sound source position comprises performing directional de-noising on the sound data through the microphone array.

Clause 16: The device of Clause 10, the processor determining the sound source location of the sound object relative to the interactive device based on the real-time image of the sound object comprises determining the sound object of the sound data according to one of the following rules in cases that a plurality of objects make sound: an object that is at the shortest linear distance from the interactive device as the sound object; or an object with the largest angle facing towards the interactive device as the sound object.

Clause 17: A computer readable storage media having computer instructions stored thereon, the instructions that, when executed, implement the method of any one of Clauses 1-8.

What is claimed is:

1. A method implemented by an interactive device, the method comprising:

determining a sound source position of a sound object relative to the interactive device based on a real-time image of the sound object;

activating a voice interaction process between the sound object and the interactive device in response to determining the sound source position of the sound object;

obtaining voice content of the sound object via the interactive device;

performing semantical analysis on the voice content;

determining that voice content of the sound object is relevant to the interactive device based on the semantical analysis; and performing a sound enhancement on sound data of the sound object based on the sound source position.

2. The method of claim 1, wherein determining the sound source position of the sound object relative to the interactive device based on the real-time image of the sound object comprises:

determining whether the sound object is facing the interactive device;

determining a horizontal angle and a vertical angle of a sounding portion of the sound object with respect to the interactive device in response to determining that the sound object is facing the interactive device; and setting the horizontal angle and the vertical angle of the sounding portion with respect to the interactive device as the sound source position.

3. The method of claim 2, wherein determining the horizontal angle and the vertical angle of the sounding portion of the sound object relative to the interactive device comprises:

forming an arc centered at the interactive device covering a viewing angle of the interactive device, a diameter of the arc corresponding to a length of an image frame;

equally dividing the arc, and using projections of equal diversion points on the imaging frame as scales;

determining a scale in which a sounding portion of a target object is located on the imaging frame; and determining angles corresponding to the determined scale as a horizontal angle and a vertical angle of the sounding portion with respect to the interactive device.

4. The method of claim 2, wherein determining the horizontal angle and the vertical angle of the sounding portion of the sound object relative to the interactive device comprises:

determining a size of a marking area of a target object in an imaging frame, wherein a sounding part is located in the marking area;

determining a distance of the target object from a camera according to the size of the marking area in the imaging frame; and calculating the horizontal angle and the vertical angle of the sounding part relative to the interactive device through an inverse trigonometric function based on the determined distance.

5. The method of claim 1, wherein performing the sound enhancement on the sound data of the sound object based on the sound source position comprises:

performing a directional enhancement on sound from the sound source position; and performing a directional suppression on sound from positions other than the sound source position.

6. The method of claim 1, wherein performing the sound enhancement on the sound data of the sound object based on the sound source position comprises performing directional de-noising on the sound data through a microphone array.

7. The method of claim 6, wherein the microphone array comprises at least one of: a directional microphone array, or an omni-directional microphone array.

8. The method of claim 1, wherein determining the sound source position of the sound object relative to the interactive device based on the real-time image of the sound object comprises determining the sound object of the sound data according to one of the following rules in cases that a plurality of objects make sound:

treating an object that is at the shortest linear distance from the interactive device as the sound object; or treating an object with the largest angle facing towards the interactive device as the sound object.

9. One or more computer readable media storing executable instructions that, when executed by one or more processors, cause the one or more processors to perform acts comprising:

determining a sound source position of a sound object relative to an interactive device based on a real-time image of the sound object;

activating a voice interaction process between the sound object and the interactive device in response to determining the sound source position of the sound object;

obtaining voice content of the sound object via the interactive device;

performing semantical analysis on the voice content;

determining that voice content of the sound object is relevant to the interactive device based on the semantical analysis; and performing a sound enhancement on sound data of the sound object based on the sound source position.

10. The one or more computer readable media of claim 9, wherein determining the sound source position of the sound object relative to the interactive device based on the real-time image of the sound object comprises:

determining whether the sound object is facing the interactive device;

determining a horizontal angle and a vertical angle of a sounding portion of the sound object with respect to the interactive device in response to determining that the sound object is facing the interactive device; and setting the horizontal angle and the vertical angle of the sounding portion with respect to the interactive device as the sound source position.

11. The one or more computer readable media of claim 10, wherein determining the horizontal angle and the vertical angle of the sounding portion of the sound object relative to the interactive device comprises:

forming an arc centered at the interactive device covering a viewing angle of the interactive device, a diameter of the arc corresponding to a length of an image frame;

equally dividing the arc, and using projections of equal diversion points on an imaging frame as scales;

determining a scale in which a sounding portion of a target object is located on the imaging frame; and determining angles corresponding to the determined scale as a horizontal angle and a vertical angle of the sounding portion with respect to the interactive device.

12. The one or more computer readable media of claim 10, wherein determining the horizontal angle and the vertical angle of the sounding portion of the sound object relative to the interactive device comprises:

determining a size of a marking area of a target object in an imaging frame, wherein a sounding part is located in the marking area;

determining a distance of the target object from a camera according to the size of the marking area in the imaging frame; and calculating the horizontal angle and the vertical angle of the sounding part relative to the interactive device through an inverse trigonometric function based on the determined distance.

13. The one or more computer readable media of claim 9, wherein performing the sound enhancement on the sound data of the sound object based on the sound source position comprises:

performing a directional enhancement on sound from the sound source position; and performing a directional suppression on sound from positions other than the sound source position.

* * * * *